United States Patent [19]

Valkama

[11] Patent Number: 5,072,646

[45] Date of Patent: Dec. 17, 1991

[54] MICROPHONE ARRANGEMENT FOR STRINGED INSTRUMENTS, PARTICULARLY FOR AN ELECTRIC GUITAR

[76] Inventor: Utria Valkama, Hakkuritie 9, SF-90800 Oulu, Finland

[21] Appl. No.: 599,678

[22] Filed: Oct. 17, 1990

[30] Foreign Application Priority Data

Oct. 23, 1989 [FI] Finland ..... 895019
Apr. 3, 1990 [FI] Finland ..... 901679

[51] Int. Cl.[5] ..... G10H 3/18

[52] U.S. Cl. ..... 84/726; 84/731; 84/743

[58] Field of Search ..... 84/726, 731, 742, 743

[56] References Cited

U.S. PATENT DOCUMENTS

| | | | |
|---|---|---|---|
| 2,455,567 | 12/1948 | Armond | 84/726 |
| 2,964,985 | 12/1960 | Webster | 84/723 |
| 3,538,807 | 11/1970 | Francis | 84/267 |
| 3,780,202 | 12/1973 | Law | 84/726 |
| 3,911,777 | 10/1975 | Rendell | 84/743 |
| 4,142,435 | 3/1979 | Pozar | 84/727 |
| 4,222,301 | 9/1980 | Valdez | 84/728 |
| 4,616,548 | 10/1986 | Anderson | 84/DIG. 30 |
| 4,869,144 | 9/1989 | Lieber | 84/726 |

FOREIGN PATENT DOCUMENTS 8802534 4/1988 World Int. Prop. O. .

*Primary Examiner*—Stanley J. Witkowski
*Assistant Examiner*—Brian Sircus
*Attorney, Agent, or Firm*—Ladas & Parry

[57] ABSTRACT

The invention relates to a microphone arrangement for an electric guitar, comprising a body and at least one microphone to be attached to the body, the body comprising slide rails enabling the position of the microphone to be altered in the longitudinal direction with respect to the strings of the electric guitar. In order that the microphones might be displaced in a reliable and durable manner and detached quickly and easily, the body comprises a brass plate, slide rails made of an electroconductive material and mounted on both sides of the brass plate in such a manner that they are electrically insulated from the brass plate, and a flexible pressure joint is provided between the slide rail and the microphone, the connection enabling a detachable bayonet connection of the microphone to the brass plate, whereby the second pole of the micrphone is, when attached to the brass plate, in electric contact with the brass plate and the first pole of the microphone, which is of opposite sign, is in electric contact with one of the slide rails.

11 Claims, 3 Drawing Sheets

MICROPHONE ARRANGEMENT FOR STRINGED INSTRUMENTS, PARTICULARLY FOR AN ELECTRIC GUITAR

BACKGROUND OF THE INVENTION

1. Field of the Invention

The invention relates to a microphone arrangement for stringed instruments, particularly for an electric guitar, comprising a body and at least one microphone to be attached to the body, said body comprising slide rails functioning as guides for the microphone in such a manner that the microphone is displaceable in the longitudinal direction of the body, which enables the position of the microphone to be altered in the direction of the strings of the instrument. The invention further relates to an electric guitar.

2. Prior Art

It is generally known that by changing the position of a microphone with respect to the strings of a guitar, the sound of the guitar and the volume produced can be altered. As it is desirable that many different sounds can be produced by a guitar, electric guitars are often provided with several microphones, usually with 2 to 4 microphones. Owing to the fact that the microphones are positioned in different places in the longitudinal direction with respect to the strings of the guitar, different sounds are produced by identical microphones. If different types of microphones are used, the tonality or sound can be altered even more. The number of microphones used at the same time has also an effect on the sound.

In order that as many sounds as possible might be obtained with a single microphone, it is known to mount the microphone displaceably in the longitudinal direction of the strings of the instrument. U.S. Pat. No. 2,455,567, for example, discloses an arrangement wherein the microphone is mounted to be guidable on a bar parallel to the strings of the instrument. The bar is stationary with respect to the body of the instrument, and the microphone arrangement is provided with guide grooves receiving said bar. U.S. Pat. No. 4,616,548 discloses a solution wherein the position of the microphones can be changed by means of a knob the shaft of which can slide in a long and narrow hole parallel to the strings of the guitar. WO Patent Application No. 88/02,534 discloses a microphone arrangement wherein the microphones can be displaced in the longitudinal direction of the strings of the instrument. For this purpose the microphone arrangement comprises plastic slide rails functioning as guides for the microphones.

The problem with the known microphone arrangements is that when the microphones are moved back and forth in the direction of the strings, the electric wires from the microphones get into a reciprocating motion, which exerts a fatiguing load on the electric wires. The electric wires do not endure such a load very long but they break, wherefore the guitar gets out of order. The breaking of the wires is particularly annoying because, for one thing, when they break, the amplifier of the guitar gives out an unpleasant sound, which completely ruins the performance and, for another, broken electric wires cannot be quickly repaired in situ, but in order that they might be repaired, the microphone arrangement has to be disassembled.

Another problem with the known microphone arrangements is that because there is a certain invariable maximum number of microphones in the guitar, the obtaining of different sounds from the guitar is restricted. In practice, about five microphones at the most can be positioned between the neck and bridge of the guitar, and if the microphones must further be displaceable in the direction of the strings, an even smaller number of microphones is to be used. In the known microphone arrangements it is not possible to detach a microphone quickly and easily in order to change the microphone type and obtain different sounds from the guitar. The detaching of microphones requires that the microphone arrangement be disassembled, which is quite laborious and cannot be done during a performance. For this reason, a demanding musician must sometimes have even three different guitars for the same performance in order to be able to produce all the sounds he wants by his instrument. Moreover, it is expensive to buy several instruments.

SUMMARY OF THE INVENTION

The object of the present invention is to overcome the problems mentioned above. For this purpose, in the microphone arrangement according to the invention the body comprises a body plate with an electroconductive area, the slide rails are made of an electroconductive material and mounted on both sides of the body plate in such a manner that they are electrically insulated from said electroconductive area, and a flexible pressure joint is provided between the slide rail and the corresponding guide body in the microphone, said pressure joint enabling the microphone to be detachably mounted on the body plate and functioning as a bayonet connection between the microphone and the body plate, whereby the second pole of the microphone, when attached to the body plate, is in electric contact with said electroconductive area of the body plate, and the first pole of the microphone, which is of opposite sign, is in electric contact with one of the slide rails. The slide rails are preferably symmetrically positioned on the sides of the body plate and attached to support bodies displaceable along the body plate. Said support bodies are spring-loadedly attached to bodies stationary with respect to the body plate, the movement of the support bodies with respect to the stationary bodies being guided by guiding means. When the slide rails are symmetrically positioned on the body plate, a microphone can be attached to the body plate in such a manner that it is connected to either one of the slide rails. This is an important feature since the microphone arrangement according to the invention is usually provided with two microphones (selected from a fairly large number of microphones) at the same time, one being connected to one slide rail and the other to the other slide rail. The microphones are connected in this manner in order that one microphone might be electrically disconnected from the other, if desired, without difficulty. Said spring loading keeps the microphones at a desired position on the body plate and, if necessary, enables the microphones to be displaced easily and with little friction in the direction of the strings of the instrument.

This invention provides thus a bayonet connection that enables the microphones to be displaced and detached and where no electric wires, which can be damaged and which are difficult to be detached, are needed.

The most significant advantages of the microphone arrangement according to the invention are that it enables the microphones to be displaced in a reliable and durable manner in the longitudinal direction of the strings of the instrument and that it enables the microphones to be quickly and easily detached from the body of the microphone arrangement as well as attached thereto. The detachment and attachment can be effected even during playing. Owing to the fact that the microphones are detachable, the player can produce an unlimited number of different sounds by mounting different types and, if desired, a different number of microphones on the body of the microphone arrangement and by altering their position in the longitudinal direction of the strings. There is, in principle, no need to buy and use several instruments such as guitars.

BRIEF DESCRIPTION OF THE DRAWINGS

In the following the invention will be described in more detail by means of a preferred embodiment with reference to the attached drawings, wherein.

DETAILED DESCRIPTION OF THE PREFERRED EMBODIMENT

Figure 1:
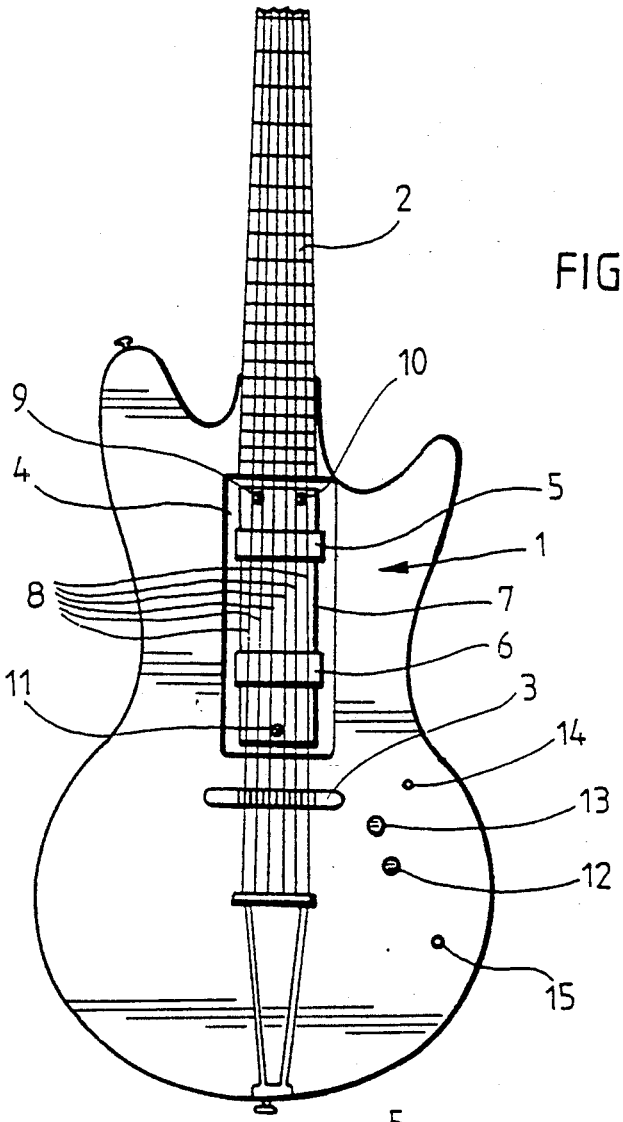
FIG. 1 shows an electric guitar provided with a microphone arrangement according to the invention.

FIG. 1 shows an electric guitar comprising a microphone arrangement according to the invention. The microphone arrangement, which is indicated in general by the reference numeral 1, is mounted in a conventional manner between the fret board 2 and the bridge 3 and is positioned in a cavity 4 in the body of the guitar. The microphone arrangement 1 comprises two microphones 5, 6, which are attached to the body 7 of the microphone arrangement. The microphones 5, 6 are displaceable along the body 7 in the direction of the strings 8 of the guitar so that their position with respect to the strings can be altered. The reference numerals 9 to 11 indicate adjusting screws by means of which the distance between the microphones 5, 6 and the strings 8 can be adjusted. It is apparent from the figure that the cavity 4 is so broad that the body 7 can be pressed from the sides by hand to detach the microphones from the body, which will be discussed in more detail below. A volume potentiometer is indicated by the reference numeral 12, a tone potentiometer is indicated by 13, and a microphone selecting switch, by which it is selected which one of the microphones is switched on, is indicated by the reference numeral 14. The switch 14 can also be set at a position in which both of the microphones are switched on. The guitar is connected to an amplifier through a female connector 15.

Figure 2:
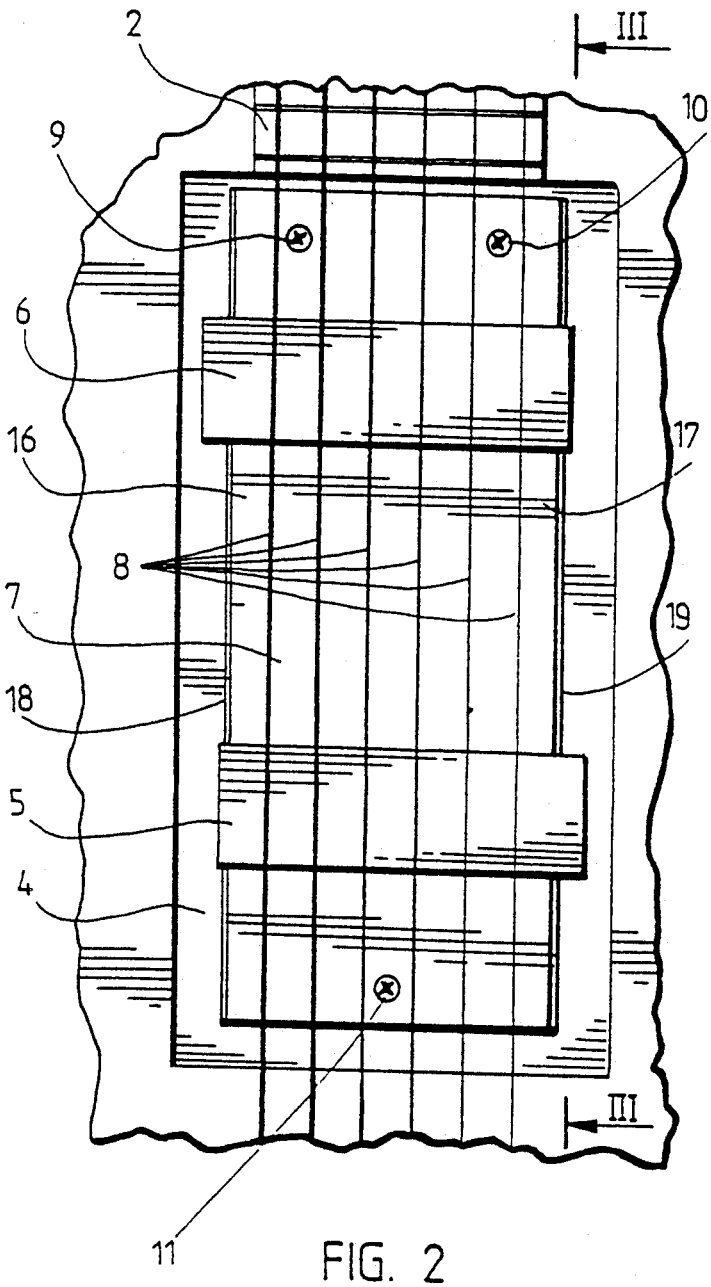
FIGS. 2 and 3 show the microphone arrangement in more detail seen from above and from the side, FIG. 3 being a cross sectional view taken along the line III—III of FIG. 2.
Figure 3:
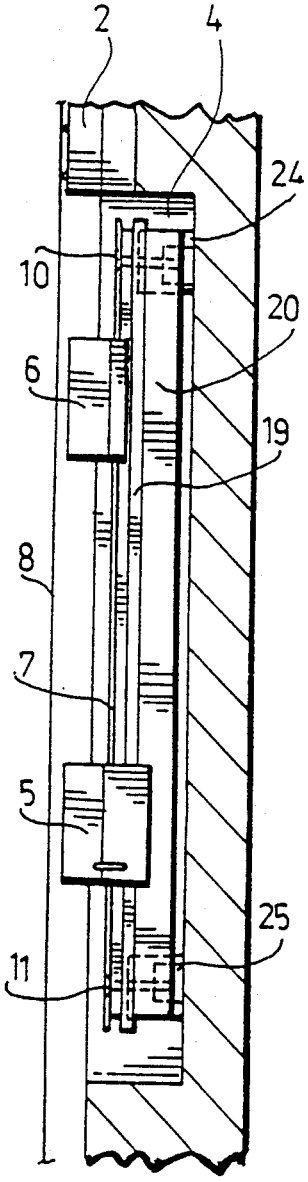

FIGS. 2 and 3 illustrate the microphone arrangement in more detail. It appears from the figures that the body of the microphone arrangement 1 comprises a body plate 7. The body plate 7 consists of a brass plate 7. Slide rails 18, 19 which are substantially parallel to each other and made of an electroconductive material, preferably steel, are mounted symmetrically on both sides 16, 17 of the brass plate 7. The slide rails 18, 19 function as guides for the microphones 5, 6 and are electrically insulated from the brass plate 7 by means of wooden support bodies 20 and 21, of which only the support body 20 appears in FIG. 3. (The support body 21 appears in FIGS. 4 and 5.) A flexible pressure joint is provided between the slide rails 18, 19 and the corresponding guide bodies (parts 22 and 23 in FIG. 5) in the microphones 5. 6, said pressure joint enabling the microphones to be detachably mounted on the brass plate 7. Said connection functions as an electroconductive bayonet connection in such a manner that the second pole of the microphones 5, 6, when attached to the brass plate 7, is in electric contact with the brass plate, and the first pole of the microphones, which first pole is of opposite sign, is attached to and in electric contact with the slide rails so that the opposite pole of the microphone 5 is attached to the slide rail 19, and the opposite pole of the microphone 6 is attached to the slide rail 18. The brass plate 7 functions as an earthing body in the connection.

FIG. 3 also shows fastening means 24, 25 for securing the microphone arrangement 1 to the bottom of the cavity 4 in the guitar. The fastening means consist of two fastening laths 24, 25 substantially perpendicular to the support bodies 20, 21. The fastening laths 24, 25 are preferably secured to the bottom of the cavity 4 by glueing or screwing. The adjusting screws 9 to 11 for adjusting the distance between the microphones 5, 6 and the strings 8, by which screws the distance and inclination of the brass plate 7 with respect to the strings 8 is in fact adjusted, are mounted on the fastening laths 24 and 25 in such a manner that two adjusting screws 9, 1O are attached to one fastening lath, one 9 at one end and the other 10 at the opposite end of said fastening lath 24, the other fastening lath 25 being provided with one adjusting screw 11 in the middle thereof. Said arrangement enables the position of the brass plate 7 with respect to the strings 8 to be easily adjusted without having to detach the microphones, which is important in order that the adjustment might be quickly and well effected. The adjusting screws 9 to 11 are spring-loaded in a manner obvious to one skilled in the art, utilizing springs mounted between the brass plate 7 and the fastening laths 24, 25. For the sake of simplicity, said springs are not indicated in the drawings.

Figure 4:
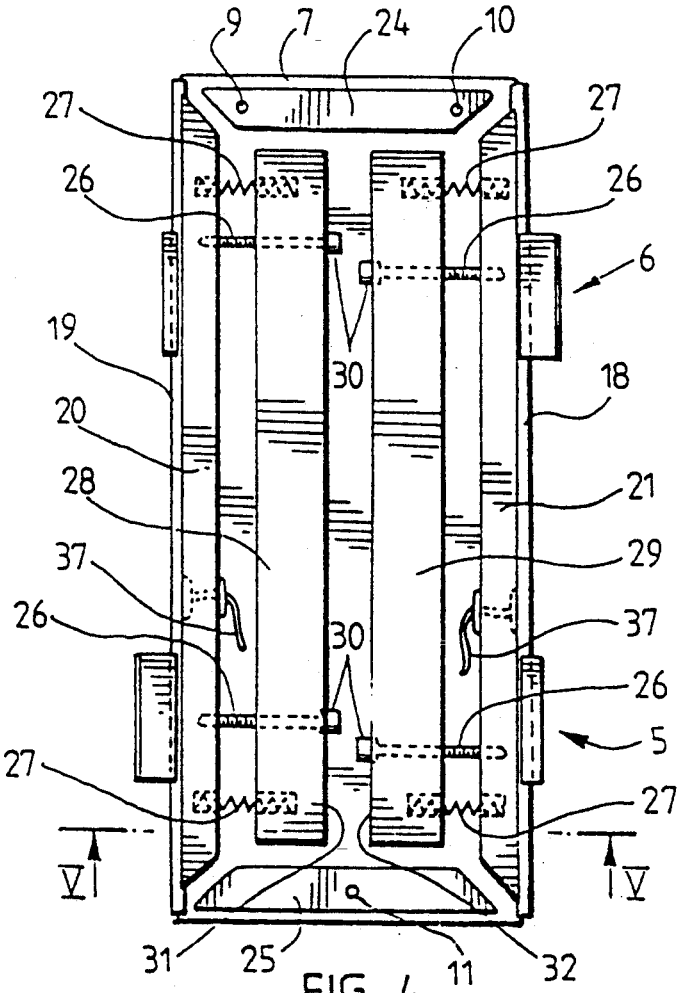
FIG. 4 shows the microphone arrangement seen from beneath.
Figure 5:
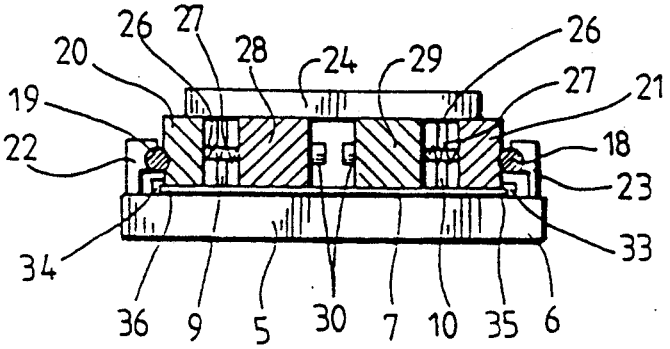
FIG. 5 is a cross sectional view taken along the line V—V of FIG. 4.

FIGS. 4 and 5 show how the pressure joint between the microphones 5, 6 and the slide rails 18, 19 has been effected. The support bodies 20, 21 mounted beneath the brass plate 7 are flexibly secured by means of screws 26 and compression springs 27 to bodies 28, 29 immovably mounted beneath the brass plate. The screws 26, which are substantially perpendicular to the slide rails 18, 19, are attached at the points thereof near the ends of the support bodies 20, 21 and penetrate the stationary bodies 28, 29 with a clearance. In the arrangement that enables the support bodies 20, 21 to be displaceable towards each other in a plane parallel to the brass plate 7, the screws 26 function as guides for the displacement of said support bodies 20, 21. The function of the springs 27 mounted between the support bodies 20, 21 and the stationary bodies 28, 29 is to press the support bodies with the slide rails 18, 19 against the corresponding guide bodies (parts 22 and 23 in FIG. 5) of the microphones 5, 6. When positioned against the sides 31, 32 of the stationary bodies 28, 29, the heads 30 of the screws 26 form stopping devices that restrict the movement of the support bodies 20, 21 with respect to the stationary bodies 28, 29 so that the support bodies remain spring loaded at a given distance from each other when the microphones 5, 6 are detached from the brass plate 7. Said distance corresponds substantially to the width of the microphones 5, 6. Said springs 27 and stopping devices keep the support bodies 20, 21 and the slide rails 18, 19 always at a suitable distance from each other in view of easy mounting of the microphones 5, 6. Owing to the fact that two springs 27 mounted near the ends of both of the support bodies 20, 21 are used, the support bodies can be displaced in a controlled and reliable manner.

From FIG. 4 it can be seen that electric wires 37 are attached to the slide rails 18, 19, said wires being intended to be connected to the means controlling the operation of the microphones 5, 6, i.e. to the potentiometers 12, 13 controlling the volume and tone shown in FIG. 1 and to a selector switch 14.

FIG. 5, which is a cross sectional view taken along the line V—V of FIG. 4, shows that one side of the microphones 5, 6 is provided with trough-shaped guide and contact bodies 22, 23 which are in contact with the first pole of the microphones and in electric contact with the corresponding slide rails 19, 18. The contact bodies 22, 23 are preferably made of brass, whereby good electric contact with the slide rails 18, 19 and suitable sliding surfaces are achieved. The opposite side of the microphones 5, 6 is also provided with trough-shaped guide bodies 33, 34, which are in electric contact with the second pole of the microphones and the corresponding edge 35, 36 of the brass plate 7, said edges functioning as a second guide for the microphones. The inner surface of the guide bodies 33, 34 can be provided with a sliding means.

Figure 6:
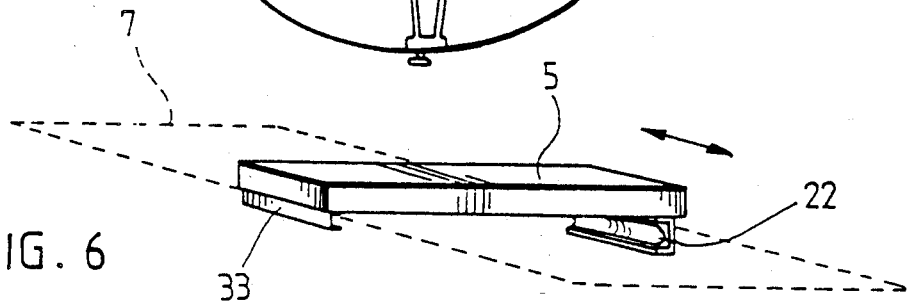
FIG. 6 shows the microphone when detached.

FIG. 6 illustrates the microphone 5 used in the microphone arrangement. The arrow illustrates the displaceability of the microphone 5 back and forth with respect to the brass plate 7.

The microphones 5, 6 are detached from the brass plate 7 and from the slide rails 18, 19 by pressing the support bodies 20, 21 from the side. When the microphone 5 is detached, the support body 20 is pressed inwards with a finger in a plane parallel to the brass plate, i.e. towards the stationary body 28, and when the microphone 6 is detached, the support body 21 is pressed inwards in a corresponding manner. When the support bodies 20, 21 are pressed inwards, the microphones 5, 6 can be lifted off the brass plate 7. The brass plate 7 must naturally be sufficiently narrow in order that the distances between the guide bodies 22, 33 and 23, 34 of the microphones 5, 6 should be sufficient to lift the microphones over the edges 35, 36 of the brass plate, cf. FIG. 5. When the microphones are lifted, the guide bodies 33 and 34 are at first lifted over the edges 35 and 36, whereafter the guide bodies 22 and 23 come off the slide rails 19, 18 without any difficulty. When the microphones are attached to the brass plate, these measures are performed in reverse order. It should be noted that if low microphones are used, they can be easily detached from the brass plate although the strings of the guitar are disposed above; if necessary, the strings must only be slightly lifted with a finger during the detachment.

The invention has been described above only by means of a preferred embodiment. It should be noted that the invention can be modified in its details in many ways within the scope of the attached claims. Thus, the body plate does not have to be a brass plate, but it can be any plate comprising an electroconductive area, i.e. a plate that has been made at least partly electroconductive, for example at the edges thereof. The main thing is that an electric connection enabling the displacement of the microphones has been arranged for the microphones in the direction of the strings of the instruments. Within the scope of the inventive concept it is therefore conceivable, for example, that the electroconductive area of the body plate is constituted by a separate electroconductive rail mounted on the body plate. The details of the flexible pressure joint between the microphones and the slide rail can be realized in many ways: the number and form of the fastening means (28, 29) can vary (the use of only one fastening means is possible), the guiding means do not have to be screws (26). It is also conceivable that the structure of the flexible connection is of such kind that &he flexibility is arranged to take place in the microphones, not in the body of the microphone arrangement (by means of support bodies). The cross section of the quide rails (18, 19) does not have to be round.

I claim:

1. A microphone arrangement for stringed instruments, particularly for an electric guitar, comprising a body and at least one microphone with first and second poles to be attached to the body, the body being provided with slide rails functioning as guides for the microphone in such a manner that the microphone is displaceable in the longitudinal direction of the body, which enables the position of the microphone to be altered in a direction parallel to the strings of the stringed instrument, said body comprising a body plate with an electroconductive area, the slide rails being made of an electroconductive material and mounted on both sides of the body plate in such a manner that they are electrically insulated from said electroconductive area, and a flexible pressure joint being provided between the slide rail and the corresponding guide body in the microphone, said pressure joint enabling the microphone to be detachably mounted on the body plate and functioning as a bayonet connection between the microphone and the body plate, whereby the second pole of the microphone is, when attached to the body plate, in electric contact with said electroconductive area of the body plate, and the first pole of the microphone, which first pole is of opposite polarity from the second pole, is in electric contact with one of the slide rails.

2. The microphone arrangement according to claim 1 wherein the slide rails are symmetrically positioned on the sides of the body plate and attached to support bodies made of an insulating material, said support bodies being displaceable towards each other along a plane parallel to the body plate and spring-loadedly attached to bodies stationary with respect to the body plate, whereby the movement of the support bodies with respect to the stationary bodies is guided by guiding means.

3. A microphone arrangement according to claim 2 wherein the guiding means are provided with stopping devices for restricting the movement of the support bodies with respect to the stationary bodies in such a manner that the support bodies and slide rails, being spring-loaded, remain at a given distance from each other when the microphone or the microphones are detached from the body plate, said distance corresponding substantially to the width of the microphone.

4. The microphone arrangement according to claim 3 wherein the guiding means consist of screws substantially perpendicular to the slide rails and attached at the point thereof near the ends of the support bodies and penetrate the stationary bodies, whereby the heads of the screws constitute stopping devices when contacting the sides of the stationary bodies.

5. A microphone arrangement according to claim 2 wherein the flexible pressure joint between the support bodies and the stationary bodies comprises compression springs mounted between the support bodies and the stationary bodies near the ends of the support bodies.

6. A microphone arrangement according to claim 1 wherein the slide rails consist of steel wires and that one edge of the microphone is provided with a trough-shaped guide and contact body which is in contact with the first pole of the microphone, the opposite edge of the microphone being provided with a trough-shaped guide body which is in electric contact with the second pole of the microphone and with the corresponding edge of the body plate, said edge functioning as said electroconductive area and as a second guide for the microphone.

7. A microphone arrangement according to claim 6 wherein the body plate comprises a brass plate to which said second pole of the microphone is electrically connected and which functions as an earthing body for said pole of the microphone.

8. A microphone arrangement according to claim 1 comprising electric wires attached to the slide rails, said wires being intended to be connected to the devices controlling the operation of the microphone such as potentiometers controlling the volume and tone and a selecting switch by which the microphone is switched on or off.

9. A microphone arrangement according to claim 1 comprising fastening means for securing the microphone arrangement to a cavity in the stringed instrument, said fastening means comprising spring-loaded adjusting screws for adjusting the height and inclination of the microphone arrangement with respect to the strings of the stringed instrument.

10. A microphone arrangement according to claim 9 wherein the fastening means consist of two fastening laths substantially perpendicular to the support bodies, two adjusting screws being attached to one fastening lath, one adjusting screw at one end and the other adjusting screw at the other end of the fastening lath, and the other fastening lath being provided with one adjusting screw in the middle thereof.

11. An electric guitar comprising a microphone arrangement mounted between the fret board and the bridge, for which arrangement the body of the guitar is provided with a cavity so that the microphone with first and second poles arrangement is at least partly positioned in the cavity, said microphone arrangement comprising a body and at least one microphone to be attached to the body, whereby the body comprises slide rails functioning as guides for the microphone in such a manner that the microphone is displaceable in the longitudinal direction of the body, which enables the position of the microphone to be altered in a direction parallel to the strings of the electric guitar, said body of the microphone arrangement comprising a body plate with an electroconductive area, the slide rails being made of an electroconductive material and mounted on both sides of the body plate in such a manner that they are electrically insulated from said electroconductive area and a flexible pressure joint being provided between the slide rail and the corresponding guide body in the microphone, said pressure joint enabling the microphone to be detachably mounted on the body plate and functioning as a bayonet connection between the microphone and the body plate, whereby the second pole of the microphone is, when attached to the body plate, in electric contact with said electroconductive area of the body plate, and the first pole of the microphone, which is of opposite polarity from the second pole, is in electric contact with one of the slide rails.

* * * * *